US005161962A

United States Patent [19]

Comerci

[11] Patent Number: 5,161,962

[45] Date of Patent: Nov. 10, 1992

[54] FLUID PUMP COMPRISED BY BLADES

[76] Inventor: Vicente Comerci, San Juan 4284, Buenos Aires, Argentina, 1233

[21] Appl. No.: 745,230

[22] Filed: Aug. 14, 1991

[51] Int. Cl.[5] ..... F04C 18/344; F04C 27/00

[52] U.S. Cl. ..... 418/147

[58] Field of Search ..... 418/147, 148, 145

[56] References Cited

U.S. PATENT DOCUMENTS

| | | | |
|---|---|---|---|
| 1,580,713 | 4/1926 | Ensign | 418/147 |
| 2,461,377 | 2/1949 | Gilson | 418/147 |
| 3,158,103 | 11/1964 | Eickmann | 418/147 |
| 3,478,728 | 11/1969 | Kelly | 418/147 |
| 3,951,111 | 4/1976 | Lester | 418/147 |
| 4,548,560 | 10/1985 | Kanao | 418/148 |

*Primary Examiner*—John J. Vrablik

*Attorney, Agent, or Firm*—Jacobson, Price, Holman & Stern

[57] ABSTRACT

The invention relates to a fluid pump having movable blades which are housed inside the rotor thereof, the blades having at portions facing the stator a concavity into which a semicircular section shoe seats and swings, the diameter of which is larger than the blade thickness, the shoes being fixed to each of the blades by means of the ends of a flexible rod, such rod embracing the blade sides and fitting into its rear portion, this assembly being housed into a substantially elliptical vertical section stator.

1 Claim, 4 Drawing Sheets

FLUID PUMP COMPRISED BY BLADES

FIELD OF THE INVENTION

The instant invention relates to a fluid pump comprised by blades to be used for pumping fluids, which may also be used as compressor, vacuum pump and to overfeed internal combustion engines.

BACKGROUND OF THE INVENTION—PRIOR ART

As already known in the art, systems constituted by blades, which are widely used since many years ago and, which due to the low cost are employed in industry in general, have low yield and may not operate at high speeds or under high pressures; therefore, several modifications and improvements have been carried out in order to solve these disadvantages which are still a concern in the art.

The first problem resides in the shape and in the way of mounting of the blades. If blades are not fixed, they are withdrawn by centrifugal forces when turning the rotor shaft, since blades are mounted inside this shaft, this action and the fact that blades are loose give rise to the continuous bending or swinging thereof, causing flow rate and pressure losses. This problem is in part solved by increasing the length of the blades, which in turn causes enlargement of pump dimensions.

If, instead of using a cylinder displaced with respect to the center of the rotor shaft, a combined cylinder is used, in order to increase the flow rate of the pump, problems are increased since combined cylinders are those having shapes other than cylindrical, which are the combination of two cylinders or the like, two ovals or the like, and, in these cases, additional problems arise since blades should slide over different or uneven surfaces, thus producing the jump of the blades and deformation thereof. In these cases grease or viscous fluids may not be used since they stick the blades inside the rotor shaft and delay outlet of fluids, causing the rotor shaft to rotate without producing any pumping action.

In order to overcome the above disadvantage, springs of varied forms and types have been used; in this case combined cylinders may not be used since springs driving the blades are quickly subject to fatigue and, in the case of a displaced cylinder, rotational speed of the pump should be reduced and the volumetric cylinder capacity under which these pumps may work should also be reduced, in order to maintain at a minimum the compression and expansion of the springs; in spite of this, after a certain working period has elapsed, springs are subject to fatigue and thus break, the blades being released thus bumping and damaging, while the wastes of broken springs damage the rotor shaft.

Also, there are systems allowing the control of the blades; these are based on the use of an eccentric housed inside the rotor shaft, this eccentric has the same shape of the cylinder, whether a displaced or combined cylinder, and by means of different kinds of modifications and adapting techniques, the effect is attained of the blades rotating as per the cylinder contour; to this end, blades have at one of their ends a connecting rod head connected on said eccentric. This makes that when the rotor shaft rotates the blades copy the shape of the eccentric and may operate exactly in accordance with the cylinder contour. In such cases, the blades make two movements, one alternating movement, entering and exiting from the rotor shaft, and a swinging movement, since they are mounted on an eccentric and, therefore, they should accommodate different positions; this means that each blade should be mounted on swinging cylindrical bushes, that all the parts should fit precisely inside the rotor shaft, thus making these pumps of great volume and cost and, in spite of the precision demanded by their construction and since blades contact the cylinder, wearing of both parts is produced, leaving a space or gap between both parts. Since this is a rigid system for control and guidance of blades, the latter may not compensate such wearing, thus leaving a space between the front of the blades and the cylinder, through which the fluid being pumped exhausts.

Another alternative to overcome the problem of controlling and guiding the blades is to include two pins, one at each side of the blades and at the rear part of the blades; such pins are provided with rollers rotating within a groove made within each of the covers. This groove has the same shape than that selected for the cylinder contour and in this way, upon rotation of the rotor shaft, blades also rotate and the pins copy the shape of the groove. In this case the problems are the same as those of the former alternative, namely the front of the blades wears and a space is left between the blades and the cylinder; and since this system is also rigid, blades may not compensate such wear, which causes fluid losses; further, the space or gap existing between the pins and the roller and the roller and the groove into which they are housed, cause bumping of the equipment and, due to the noise produced, they may not operate at high speeds, since the pins are continuously subject to breakage.

A further disadvantage is that all these devices comprised by blades may not operate under high pressure and that in spite of all the improvements and modifications carried out thereon, this was not attained. This is due to the fact that, when the rotor shaft rotates, the blades, being mounted on said shaft, rotate at the same time, subscribing a circumference, but when the cylinder is displaced, namely the center of the cylinder is displaced with respect to the center of the rotor shaft, blades bear on one of their edges instead of bearing on their front, leaving the other edge uncovered, which gives rise to the accumulation of compressed fluids between the blades and the cylinder, which force the blades to separate from the cylinder. These disadvantages are even worse when combined cylinders are used since, although larger flow rates are obtained, the differences between the center of these cylinders and the rotor center are larger and the blades operate almost in all their travel bearing on their edges.

SUMMARY OF THE INVENTION

The instant invention solves the disadvantages of the prior art and is comprised by a single part rotor shaft, provided with two supporting shafts on which bearings are mounted; this rotor shaft is provided with housings into which the blades are housed and in which they displace. The blades, in turn, have at their front a concave cavity, into which a shoe per blade fits and swings, each of said shoes having a diameter larger than the blade thickness, each shoe being engaged to each of the blades through the ends of a flexible rod, while the other part of the rod passes to the rear part of the blade and houses therein. The whole assembly of the rotor and its blades is housed within a stator, the cavity of which has a central zone and two equal side zones, the vertical section of said cavity being substantially elliptical and regular and which, mating with the minor shaft, has two circular, equal and opposite sectors, of less than 90 degrees, and mating with the larger shaft it has two equal opposite semi-archs having variable radius and curvature, each of said semi-archs being comprised by two sectors, one of smaller curvature extending until communication with the other larger curvature sector, such that the sector corresponding to the first semi-arch, having a smaller curvature, faces the smaller curvature sector of the second semi-arch and the sector having larger curvature of the second semi-arch faces the larger curvature sector of the first semi-arch.

Therefore, when the rotor shaft rotates, the blades are introduced and exit from the rotor shaft and the half round shoes, swing and copy the stator contour and vary the volume of the chambers; in this way, the blade control and guidance system is eliminated, high operating speeds under high pressures are obtained, with very good yield and reduced manufacturing costs, which is the object of the instant invention.

DETAILED DESCRIPTION OF THE INVENTION

Figure 1:
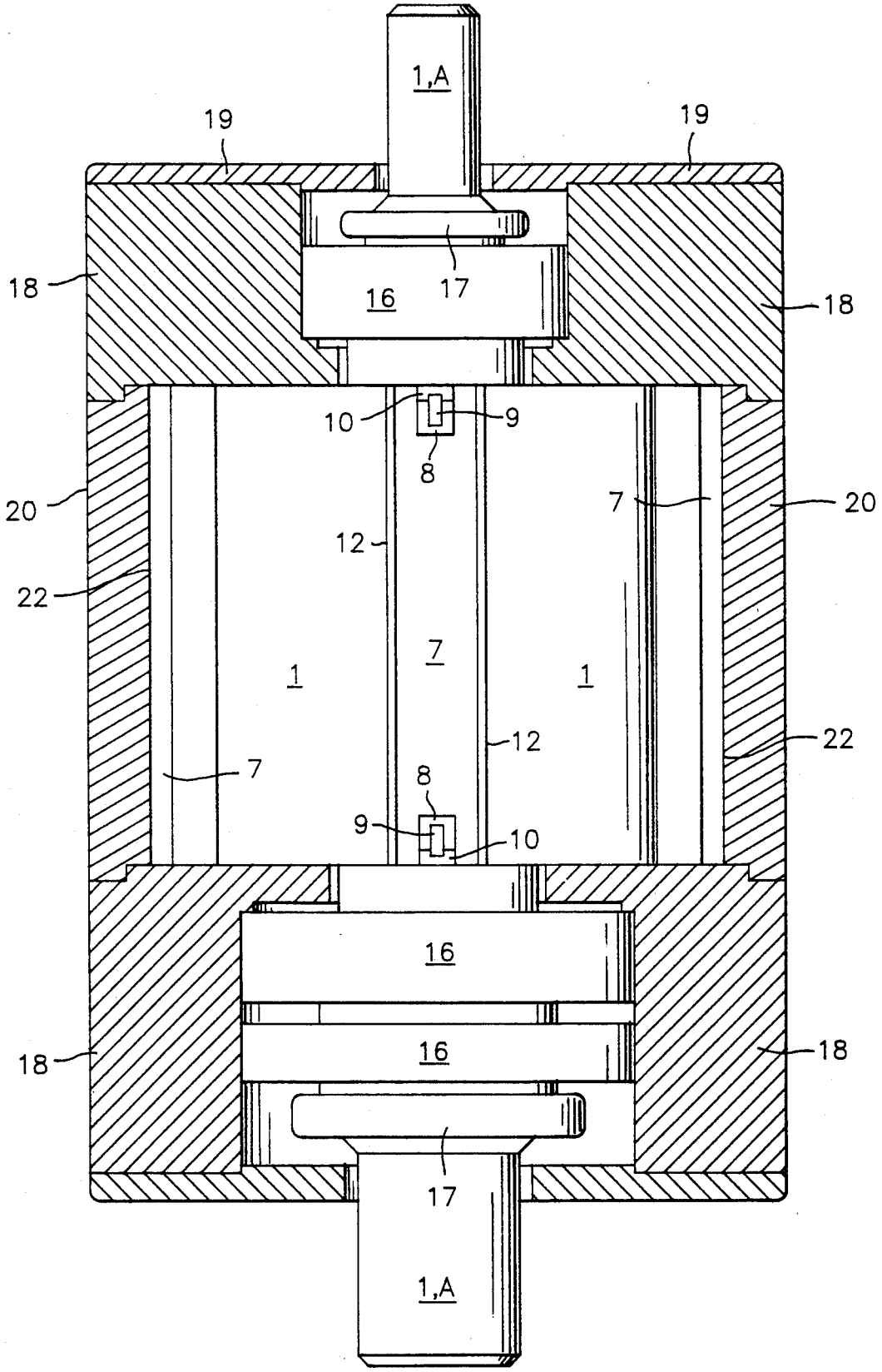
FIG. 1 is a cross-section of the whole pump assembly.

FIG. 1 shows the mounting of the rotor shaft (1), the blades (3, 4, and 6) and the way in which shoes (7) of the latter are adjusted to the inner contour of the stator (20), the front of blade (3) being shown, which allows viewing the two ends of the rod (9) housed into cavity (8) supporting the shoe (7), while groove (10) allows pivoting of the shoe (7) without abutting the ends of the flexible rod (9).

Figure 2:
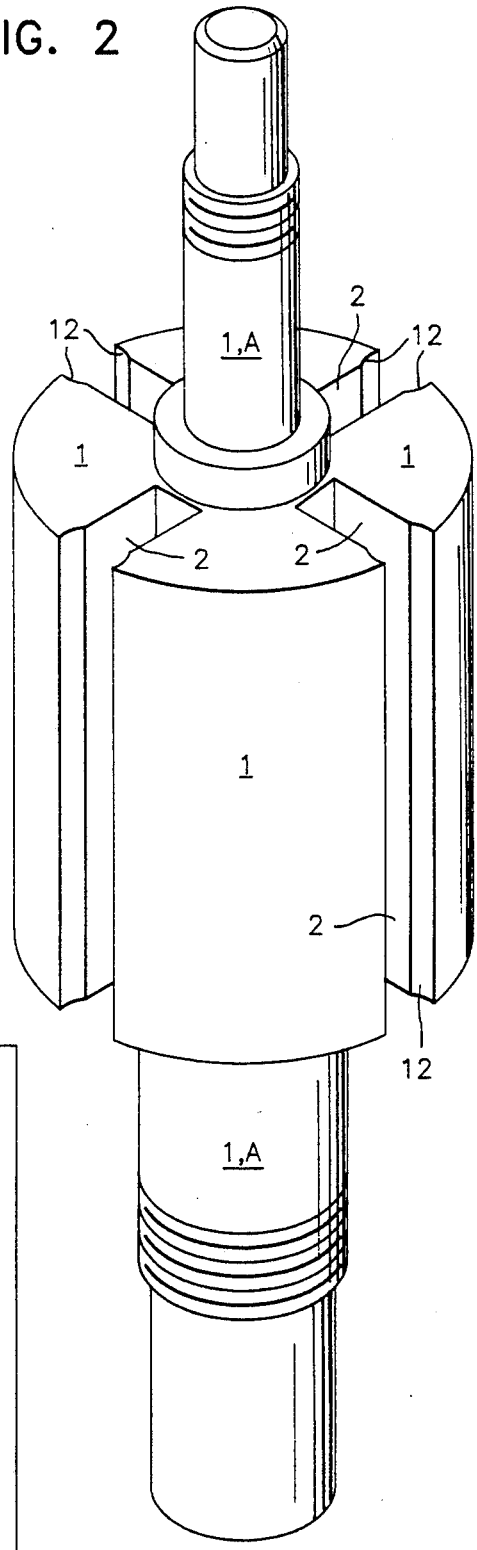
FIGS. 2, 3, 4 and 5 are exploded views of the pump.

FIG. 2 shows the rotor shaft (1) and its two supporting shafts (1*a*) solidary to the rotor shaft (1), housings (2) for the blades and channels (12) into which shoes (7) are housed.

Figure 3:
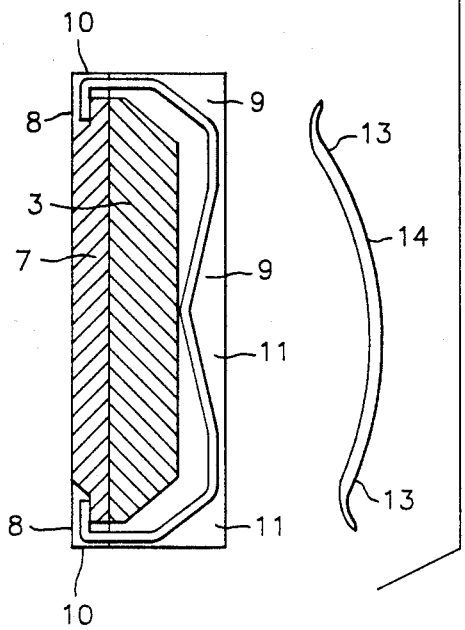

The cross section of FIG. 3 shows blade (3), blades (4, 5 and 6) being similar to blade (3). The latter have been designated with different numbers only to the effect of clarity of operating cycles.

Blade (3) is provided with a housing (11) into which the flexible rod fits (9), which in turn is introduced into cavities (8) having the swinging shoe (7), maintaining said shoe resiliently connected to its concave seat (15) in the blade (3), while grooves (10) having the shoe (7), allow the free swinging thereof without abutting the flexible rod (9) and the resilient strip (13) is fixed through its hole (14) in the interior of housing (2) of the rotor shaft (1); this resilient strip actuates through the rear part of the blade (3) thus avoiding blade sticking inside its housing (2).

Figure 4:
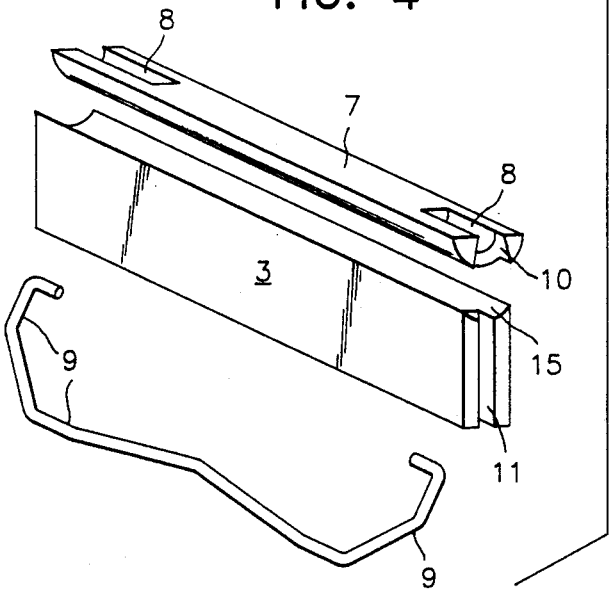

FIG. 4 is an exploded view of the same blade clearly showing its components.

Figure 5:
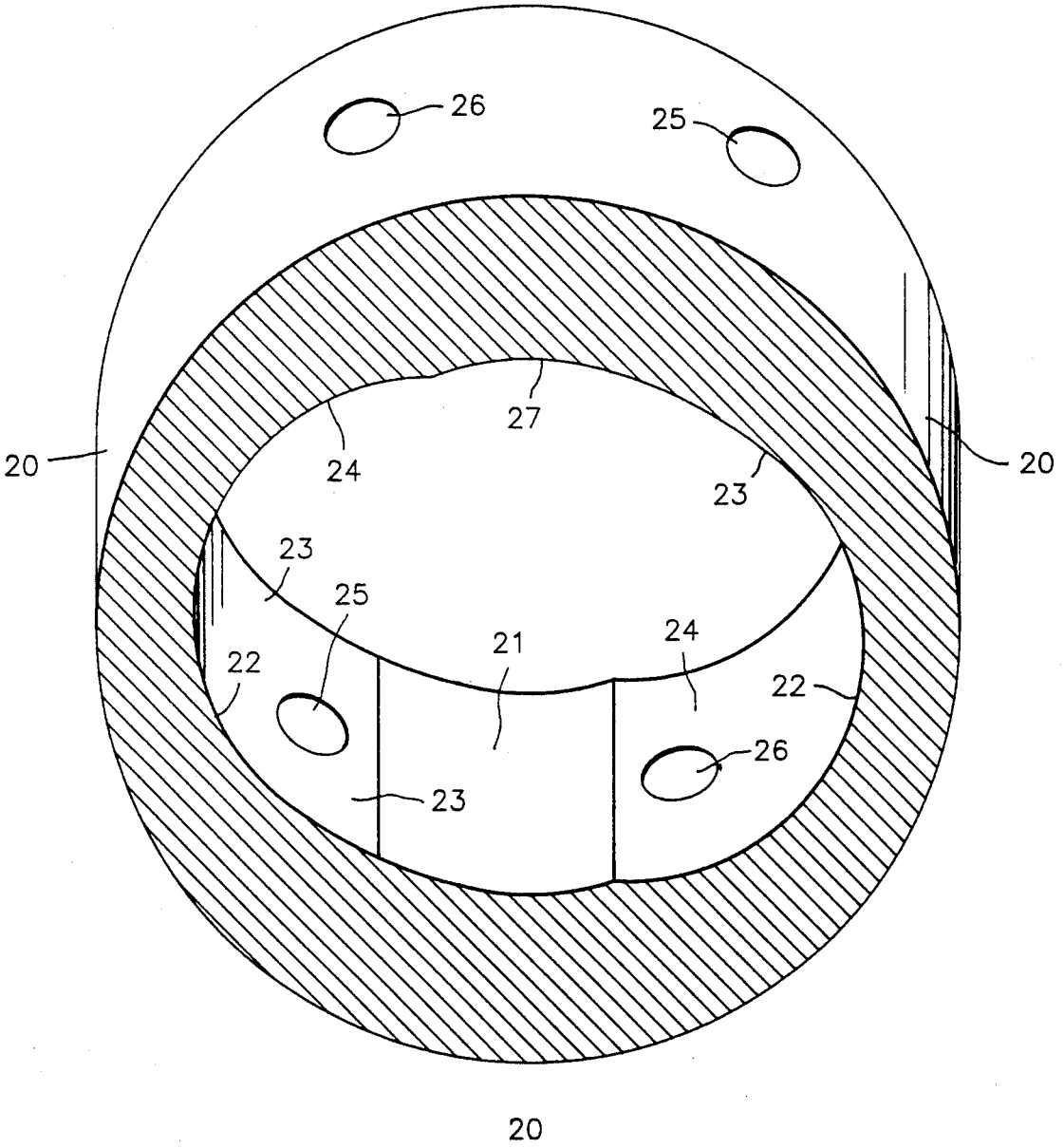

FIG. 5 shows stator (20) having an inner configuration formed by two cylindrical sectors (21) which face each other, from which the inner surface projects at both sides of the cylindrical sectors (21) as a semi-arch (22), these semi-arched section surfaces having two sectors (23), the smaller curvature of which is smaller than that of sectors (24); also it is shown that curved surfaces (23) gradually extend until they communicate with surfaces (24). In this figure, inlet (25) and outlet (26) pipings are also shown. It is to be note that these pipings are only included as an example and should be considered as optional features of the invention due to the variety of applications which may be given to the equipment, such as: vacuum pump, gas compressor, fluid pump, or internal combustion engines and, therefore, requirements are different for each case.

Figure 6:
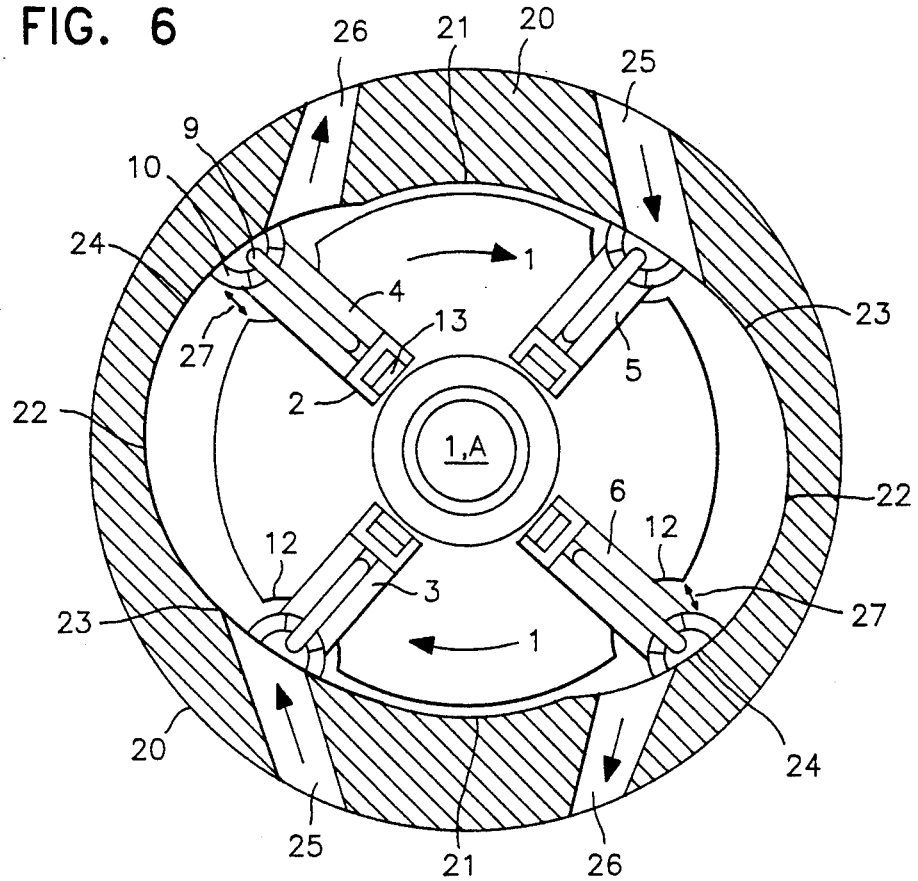
FIGS. 6 and 7 are front views of the equipment showing the operating cycles.

FIG. 6 shows the front of the pump, with the cover (18) removed in order to see the operation thereof. In this figure it may be seen that the fluid is suctioned and enters through piping (25) filling sectors (23 and 24); this is due to the fact that blades (3 and 5) are less projected from the rotor shaft (1) than blades (4 and 6) which indicates that in sectors (23) the volume is less than in sectors (24) and, therefore, the volume difference causes a depression originating the admission through suction, since shoes (7) of blades (3 and 5) allow the continuous passage of fluid to those sectors, while between the sectors (24), the partially cylindrical surfaces (21) and blades (4 and 6) pumping and pressure outlet of fluid through pipings (26) take place.

Figure 7:
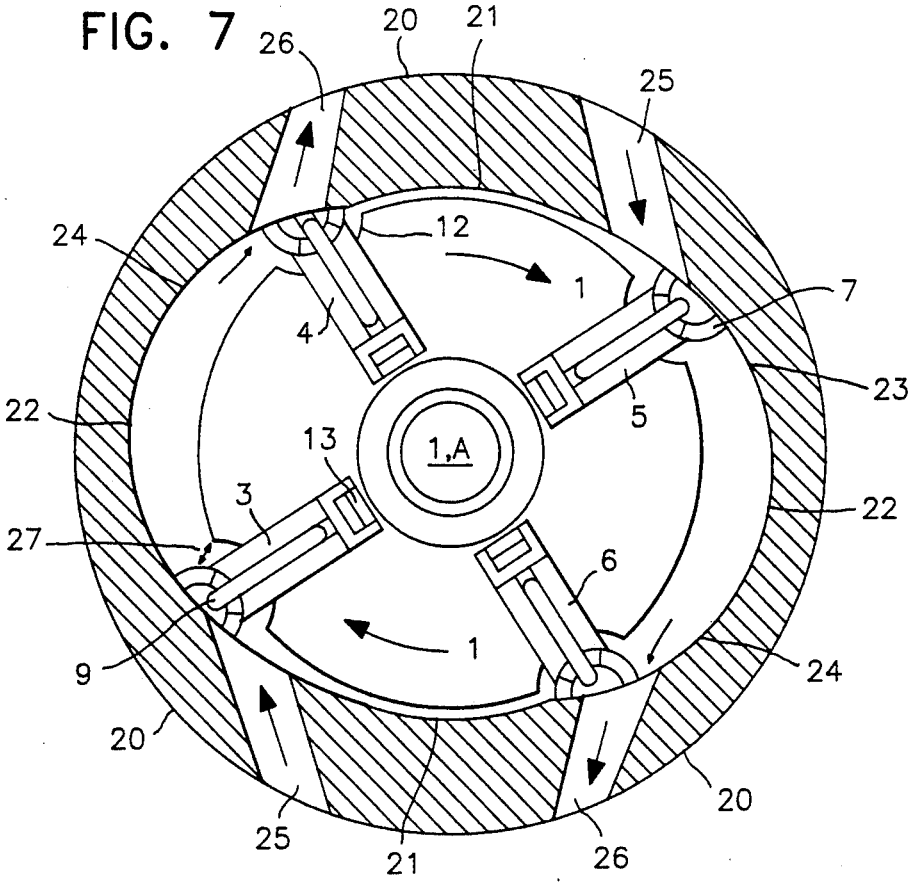

FIG. 7 shows blades (3 and 4) which have already passed through the inlet piping (25) and blades (4 and 6) which are on the outlet piping of the pressurized fluid (26); as may be seen, shoes (7) of blades (4 and 6) are abutting the partially cylindrical sectors (21), therefore, no fluid to be pumped remains, but, between blades (3 and 5), partially cylindrical sectors (21) and piping (25) there is enough volume such as to cause depression admission suctioning the fluid entering through piping (25), while fluid in sectors (23 and 24) is exhausted and exits passing through blades (3 and 5) through piping (26).

As seen in FIGS. 6 and 7, the resilient strips (13) only act driving blades when they are close to or on the partially cylindrical surfaces (21), since afterwords the same operating fluid pressure is accumulated between shoes (7) and the rotor shaft (7) as shown by arrows (27), forcing shoes (7), and the latter, through flexible rods (9) forcing the blades to slide and project from the rotor shaft (1) thus maintaining the whole assembly adjusted to the inner contour of the stator (20). As mentioned above, since a volume difference exists between sectors (23 and 24), it is possible that the pump continues suctioning fluid through volume difference until the moment in which fluid is pumped. This means that continuous suction admission is obtained and, upon elimination of pressure equilibrium in the working chambers, a higher yield of the pump equipment is obtained and flow rate and working pressure lowering or raising peaks are also eliminated.

I claim:

1. Fluid pump comprised by blades of the type comprised by a single part rotor with an axis, provided with two smaller diameter portions on which bearings are mounted, between said portions there being a larger diameter portion in which there are, parallel to the rotor axis, housings for mounting and sliding the blades, wherein each of the blade housings is provided with a concave channel parallel to the rotor axis, each of said channels being divided into two parts by each of the blade housings of the rotor, the larger diameter portion of the rotor and the blades being housed in a central portion of a stator which has equal and opposite semi-archs of variable radius and curvature, each of said semi-archs being formed by two sectors, one of smaller curvature extending until communicating with the other larger curvature section, such that the smaller curvature sector faces the smaller curvature sector of the second semi-arch, and the larger curvature sector of the second semi-arch faces the larger curvature sector of the first semi-arch, contacting the inner part of the stator there being a half-round swinging shoe on each blade, said shoes each being mounted on a concave surface at the front of each blade, each shoe having, in turn, at one of its ends a cavity housing one end of a flexible rod, which passes through sides and rear parts of the blade with the other end of the flexible rod housed within a cavity at the other end of the half-round swinging shoe.

* * * * *